US010249469B2

(12) United States Patent
Steinlage et al.

(10) Patent No.: US 10,249,469 B2
(45) Date of Patent: Apr. 2, 2019

(54) FABRICATION METHODS AND MODAL STIFFINING FOR NON-FLAT SINGLE/MULTI-PIECE EMITTER

(71) Applicant: General Electric Company, Schenectady, NY (US)

(72) Inventors: Gregory Alan Steinlage, West Milwaukee, WI (US); Andrew Marconnet, West Milwaukee, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/085,419

(22) Filed: Mar. 30, 2016

(65) Prior Publication Data

US 2017/0287669 A1 Oct. 5, 2017

(51) Int. Cl.

| | |
|---|---|
| ***H05G 1/02*** | (2006.01) |
| ***H01J 35/06*** | (2006.01) |
| ***H01J 35/10*** | (2006.01) |

(52) U.S. Cl.

CPC ..... *H01J 35/06* (2013.01); *H01J 35/10* (2013.01); *H05G 1/02* (2013.01)

(58) Field of Classification Search

CPC . H01J 35/10; H01J 35/06; H01G 1/02; H05G 1/02

USPC ..... 313/310

See application file for complete search history.

(56) References Cited

U.S. PATENT DOCUMENTS

| | | | | |
|---|---|---|---|---|
| 3,740,606 | A | 6/1973 | Hoppel | |
| 7,531,206 | B2 * | 5/2009 | Lee | B82Y 30/00 313/495 |
| 8,211,320 | B2 | 7/2012 | Pei | |
| 2010/0316192 | A1 * | 12/2010 | Hauttmann | H01J 35/06 378/136 |
| 2012/0269326 | A1 * | 10/2012 | Adler | H01J 35/08 378/138 |
| 2018/0269025 | A1 * | 9/2018 | Steinlage | H01J 35/06 |

OTHER PUBLICATIONS

Non-Final Rejection towards U.S. Appl. No. 15/984,015 dated Aug. 1, 2018.

* cited by examiner

*Primary Examiner* — Christopher Raabe

(57) ABSTRACT

An electron emitter assembly includes a plurality of electron emitters, and a removable structure connected to, and fixing a positional relationship among, individual ones of the plurality of electron emitters. A method of assembling an electron emitter assembly includes connecting individual ones of a plurality of electron emitters together with a removable structure, and fixing a positional relationship among the individual ones of the plurality of electron emitters.

12 Claims, 13 Drawing Sheets

FABRICATION METHODS AND MODAL STIFFINING FOR NON-FLAT SINGLE/MULTI-PIECE EMITTER

FIELD

The disclosed exemplary embodiments relate generally to X-ray generation, and more particularly to one or more X-ray emitter structures for an X-ray tube.

BACKGROUND

In non-invasive imaging systems, X-ray tubes are used in various X-ray systems and computed tomography (CT) systems as a source of X-ray radiation. Typically, an X-ray tube includes a cathode and an anode. An emitter within the cathode may emit a stream of electrons in response to heat resulting from an applied electrical current. The electron stream may be guided toward the anode by one or more electrical or magnetic fields positioned along the electron stream. The anode generally includes a target that is impacted by the stream of electrons. The target may, as a result of impact by the electron beam, produce X-ray radiation that is emitted from the X-ray tube.

In typical imaging applications, the radiation passes through a subject of interest, such as a patient, baggage, or an article of manufacture, and a portion of the radiation impacts a detector or photographic plate where the image data is collected. The detector produces signals representative of an amount or intensity of radiation impacting discrete elements of the detector. The signals may then be processed to generate an image that may be displayed for review. In CT systems, a detector array, including a series of detector elements, produces similar signals through various positions as a gantry is rotated about a patient. In other systems, such as systems for oncological radiation treatment, the X-ray tube may produce ionizing radiation directed toward a target tissue.

The cathode of an X-ray tube may include one or more emitters having various configurations. However, as emitters are generally becoming larger, the first resonant frequency is being driven lower and lower. This modal frequency eventually arrives within the range of other structurally relevant frequencies of the X-ray tube, such as the anode rotor operational frequency. When this modal frequency exists at, or below the other operational frequencies of the X-ray tube, energy may be deposited into this mode, introducing emitter deformation and encouraging additional failure modes. Furthermore, the larger emitters may have less structural rigidity resulting in challenges during fabrication, assembly, shipment, and operation. In addition, multiple emitters may be used, compounding placement accuracy problems, in particular when placing them in close proximity to each other or any external geometry.

It would be advantageous to provide methods for fabrication and stiffening that overcome these and other disadvantages.

SUMMARY

In at least one aspect of the disclosed embodiments, an electron emitter assembly includes a plurality of electron emitters, and a removable structure connected to, and fixing a positional relationship among, individual ones of the plurality of electron emitters.

The removable structure may include one or more ligaments connected among the individual ones of the plurality of electron emitters.

The removable structure may include a substrate supporting the individual ones of the plurality of electron emitters.

At least a portion of the removable structure may be removable by an ablation process.

At least a portion of the removable structure may be removable by a separation process.

At least a portion of the removable structure may be retained to provide modal stiffness for the individual ones of the plurality of electron emitters.

The positional relationship among the individual ones of the plurality of electron emitters may be planar.

The positional relationship may be an out of plane relationship among the individual ones of the plurality of electron emitters.

The out of plane relationship among the individual ones of the plurality of electron emitters may be effected by a bend applied to the removable structure.

At least a portion of the removable structure may be retained to provide a current path among the individual ones of the plurality of electron emitters.

In one or more aspects of the disclosed embodiments, a method of assembling an electron emitter assembly includes connecting individual ones of a plurality of electron emitters together with a removable structure, and fixing a positional relationship among the individual ones of the plurality of electron emitters.

The removable structure may include one or more ligaments connected among the individual ones of the plurality of electron emitters.

The removable structure may include a substrate supporting the individual ones of the plurality of electron emitters.

The method of assembling an electron emitter assembly may include removing at least a portion of the removable structure by an ablation process.

The method of assembling an electron emitter assembly may include removing at least a portion of the removable structure by a separation process.

The method of assembling an electron emitter assembly may include retaining at least a portion of the removable structure to provide modal stiffness for the individual ones of the plurality of electron emitters.

The positional relationship among the individual ones of the plurality of electron emitters may be planar.

The positional relationship may be an out of plane relationship among the individual ones of the plurality of electron emitters.

The method of assembling an electron emitter assembly may include forming the out of plane relationship among the individual ones of the plurality of electron emitters by applying a bend to the removable structure.

The method of assembling an electron emitter assembly may include retaining at least a portion of the removable structure to provide a current path among the individual ones of the plurality of electron emitters.

BRIEF DESCRIPTION OF THE DRAWINGS

The foregoing and other aspects of the disclosed embodiments are made more evident in the following Detailed Description, when read in conjunction with the attached Drawing Figures, wherein.

DETAILED DESCRIPTION

Figure 1:
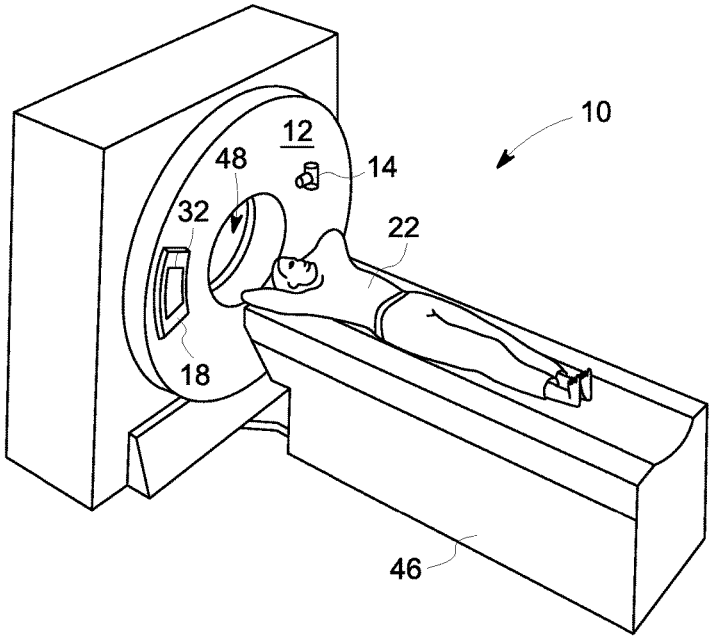
FIG. 1 shows a diagram of an imaging system incorporating one or more of the disclosed embodiments.

FIG. 1 shows an exemplary computed tomography (CT) imaging system 10 in which the disclosed embodiments may be utilized. The imaging system 10 includes a gantry 12 with an X-ray source or tube 14 and a detector assembly 18. The X-ray tube 14 may project a beam of X-rays 16 toward the detector assembly 18 which may be located on an opposite side of the gantry 12. The detector assembly 18 may include a plurality of detectors 20 (FIG. 2) and a data acquisition system 32. The plurality of detectors 20 may sense the projected X-rays that pass through a subject of interest 22, for example a medical patient, and the data acquisition system 32 may convert signals from the detectors 20 to digital data for subsequent processing. Each detector 20 may produce an electrical signal that represents an intensity of an attenuated beam as it passes through the subject of interest 22. During a scan to acquire X-ray projection data, the gantry 12 and the components mounted thereon may rotate about a center of rotation 24 (FIG. 2).

Figure 2:
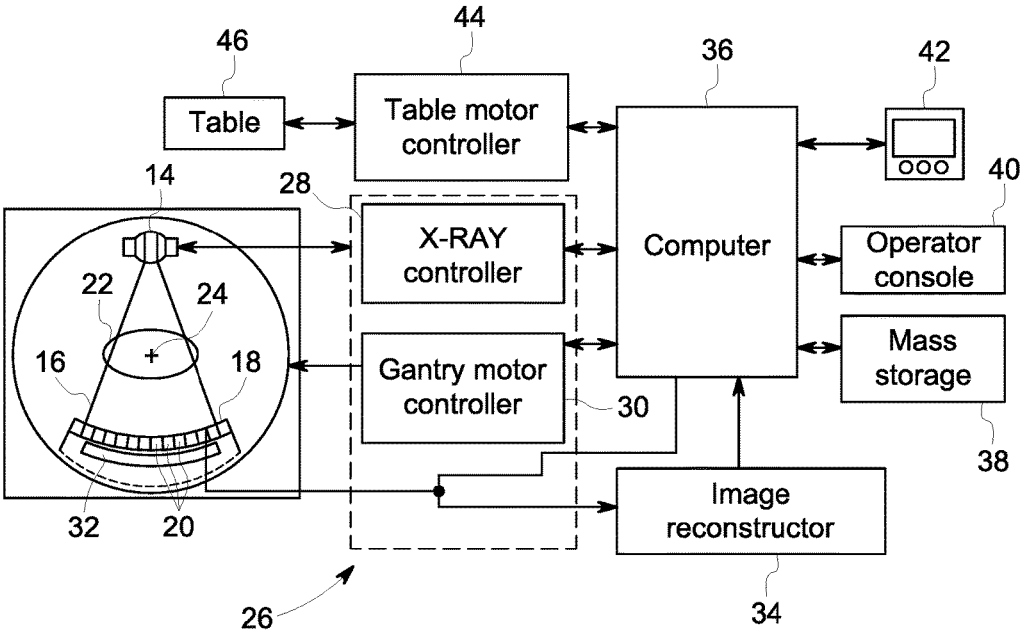
FIG. 2 shows a block diagram of the imaging system of FIG. 1.

FIG. 2 shows a block diagram of the imaging system of FIG. 1. A control mechanism 26 may control rotation of the gantry 12 and the operation of the X-ray tube 14. The control mechanism 26 may include an X-ray controller 28 that provides power and timing signals to the X-ray tube 14 and a gantry motor controller 30 that controls a rotational speed and position of gantry 12. An image reconstructor 34 may receive sampled and digitized X-ray data from the data acquisition system 32 and may perform an image reconstruction. The reconstructed image may be applied as an input to a computer 36 that stores the image in a mass storage device 38.

The computer 36 may also receive commands and scanning parameters from an operator via a console 40 that may have a user interface, for example, a keyboard, mouse, voice activated controller, or any other suitable input apparatus. An associated display 42 may allow a user to observe the reconstructed image and other data from the computer 36. User supplied commands and parameters may be used by the computer 36 to provide control signals and information to the data acquisition system 32, the X-ray controller 28, and the gantry motor controller 30. In addition, the computer 36 may operate a table motor controller 44 that controls a motorized table 46 to position the subject of interest 22 and the gantry 12. The table 46 may move the subject of interest 22 partly or wholly through a gantry opening 48 (FIG. 1).

Figure 3:
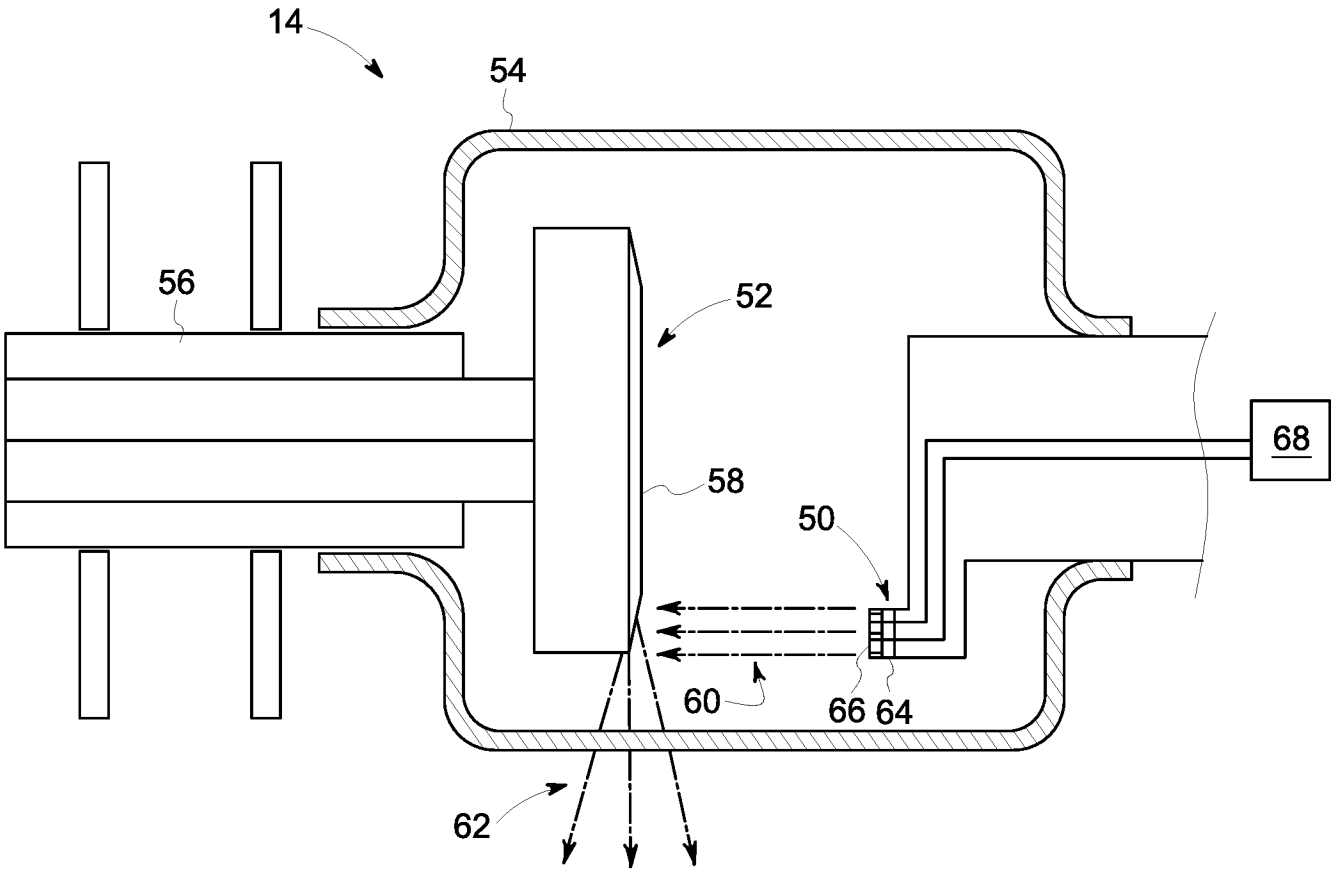
FIG. 3 is a schematic diagram of an X-ray tube according to the disclosed embodiments.

FIG. 3 shows a diagram of the exemplary X-ray tube 14 according to the disclosed embodiments. The X-ray tube 14 may include a cathode assembly 50 and an anode assembly 52 encased in a housing 54. The anode assembly 52 may include a rotor 56 configured to turn a rotating anode disc 58 also referred to as a target. When struck by an electron current 60 from the cathode assembly 50, the anode 58 emits an X-ray beam 62.

The cathode assembly 50 and the anode assembly 52 may be supported within a housing 54 defining an area of relatively low pressure (e.g., a vacuum). The housing 54 may be constructed of various materials including, for example, glass, ceramic, stainless steel, or other suitable materials. The target 58 may be manufactured of any metal or composite, for example, tungsten, molybdenum, copper, or any material that contributes to generating radiation when bombarded with electrons. The target's surface material is typically selected to have a relatively high thermal diffusivity to withstand the heat generated by electrons impacting the target 58. The space between the cathode assembly 50 and the target 58 may be evacuated to minimize electron collisions with other atoms and to increase high voltage stability. Moreover, such evacuation may advantageously allow a magnetic flux to quickly interact with (i.e., steer or focus) the electron beam 62. Electrostatic potential differences are created between the cathode assembly 50 and the anode 58, causing electrons emitted by the cathode assembly 50 to accelerate towards the anode 58.

The cathode assembly 50 may include one or more emitters 66 mounted on a support 64. The support 64 may provide a mounting surface for the one or more emitters 66. In some embodiments the support 64 may include a focusing cup or focusing head that may at least partially circumscribe the one or more emitters 66. In one or more embodiments, the support 64 may contact the emitters 66 along one or more edges. In some embodiments, the support may 64 include one or more posts on which the one or more emitters 66 may be mounted. A power supply 68 may provide drive current to heat the one or more emitters 66 to promote electron emission. The emitters 66 may include suitable materials to facilitate electron emission, including, for example, various anisotropic polycrystalline materials such as tungsten, tungsten alloy, tantalum, or hafnium carbide.

Figure 4A:
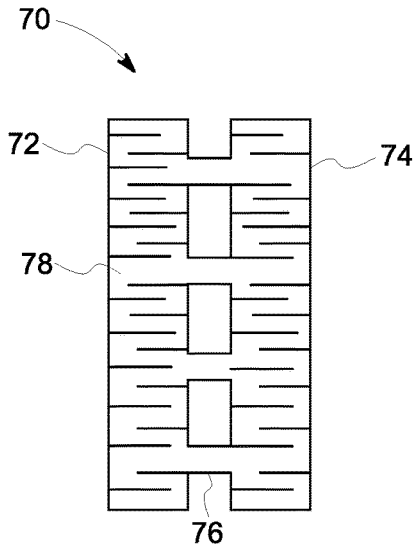
FIGS. 4A-4C show an exemplary set of emitters fabricated with ligaments according to the disclosed embodiments.

FIG. 4A shows an exemplary set of emitters 70. According to the disclosed embodiments, the emitter set 70 may be fabricated with a support structure to facilitate installation in an X-ray tube. In some embodiments, a portion of the support structure may be removed after installation. For example, the emitter set 70 may be fabricated from a sheet of emitter material, for example, by laser cutting a tungsten sheet, to yield two emitters 72, 74 connected by one or more ligaments 76.

Figure 4B:
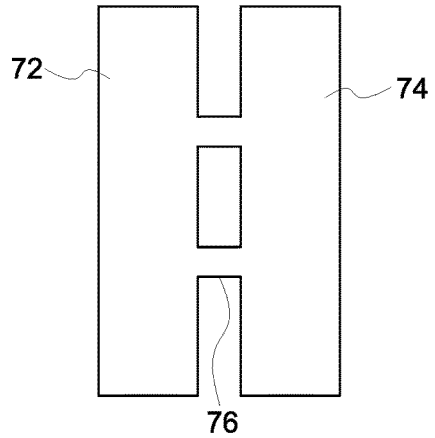

It should be understood that the emitter set 70 may be fabricated to yield any suitable number of emitters. The emitters may have meander conduction paths 78 or may have any other suitable conduction path configuration. The ligaments 76 may operate to fix a positional relationship between the two emitters 72, 74 to facilitate installation. For example, rather than attempting to precisely locate two or more emitters relative to each other and relative to other structures within the cathode assembly, the ligaments may simplify operations by allowing the placement of a single object or structure within the cathode assembly. The emitter set 70 may be fabricated as a substantially flat sheet of material. FIG. 4B shows an embodiment of the emitters 72, 74 as installed in the cathode assembly 50 where the positional relationship among the emitters 72, 74 is planar, that is the emitters 72, 74 are substantially in the same plane.

The emitters 72, 74 may be installed by bonding, welding, brazing, or any suitable attachment method for attaching the emitters 72, 74 to support structures in the cathode assembly. The support structures may include mounting posts or other structures.

Figure 4C:
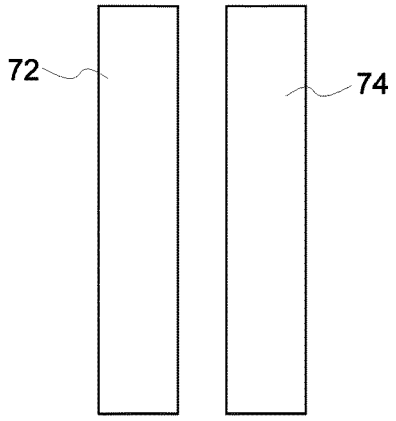

In this embodiment, one or more of the ligaments 76 may be left in place to provide modal stiffness and other ligaments may be removed, for example, by an ablation process, a separation process, for example, a chemical separation process or heat separation process, or some other suitable removal process. In some embodiments, all the ligaments 76 may be left in place. Ligaments 76 remaining connected to the emitters 72, 74 may be altered to achieve specific current flows through the emitters 72, 74 as will be described below. FIG. 4C shows another embodiment of the emitters 72, 74 as installed in the cathode assembly 50 where all of the ligaments are removed.

Figure 5A:
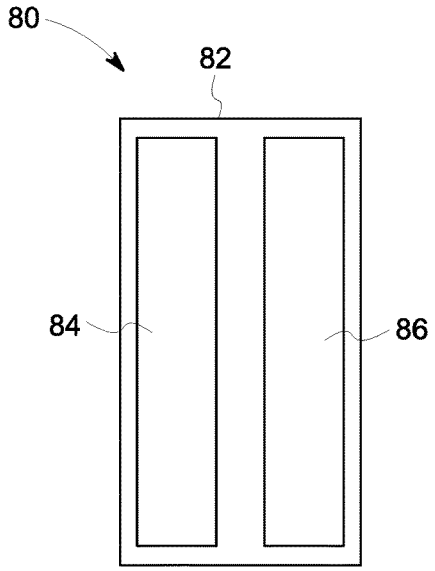
FIGS. 5A-5C show an exemplary set of emitters fabricated on a substrate according to the disclosed embodiments.

FIG. 5A shows another exemplary set of emitters 80. The emitter set 80 may be fabricated by depositing emitter material onto a substrate 82 to yield a plurality of emitters, for example, emitters 84, 86.

Figure 5B:
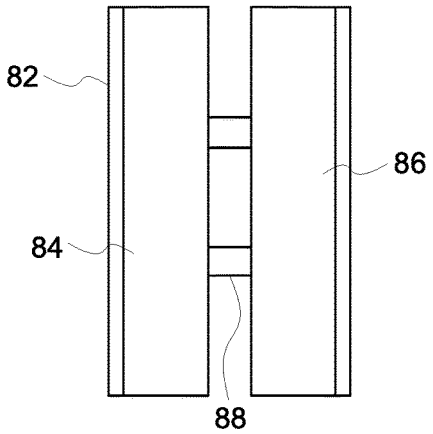
Figure 5C:
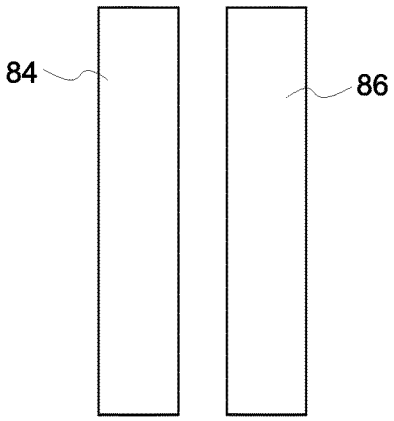

The emitters 84, 86 may have meander conduction paths or may have any other suitable conduction path configuration. In this embodiment, the substrate 82 may be flat and may operate to fix a positional relationship between the two emitters 84, 86 to facilitate installation in the cathode assembly 50. FIG. 5B shows an embodiment of the emitters 84, 86 as installed. In this embodiment, one or more portions 88 of the substrate 82 itself may be retained or left in place to provide modal stiffness and other portions of the substrate 82 may be removed, for example, by a suitable removal process as mentioned above. In some embodiments, the entire substrate 82 may be left in place. FIG. 5C shows another embodiment of the emitters 84, 86 as installed where the substrate 82 has been completely removed after installation.

Figure 6A:
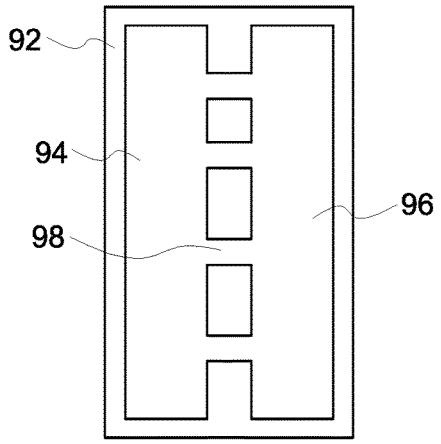
FIGS. 6A-6C show an exemplary set of emitters fabricated with ligaments on a substrate according to the disclosed embodiments.
Figure 6B:
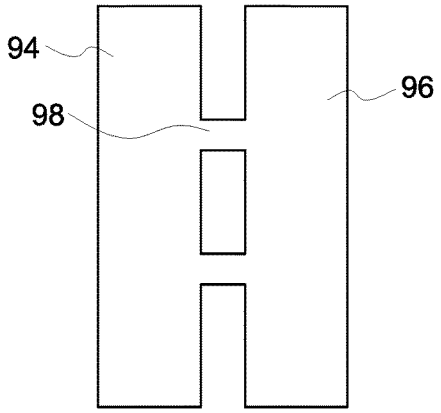
Figure 6C:
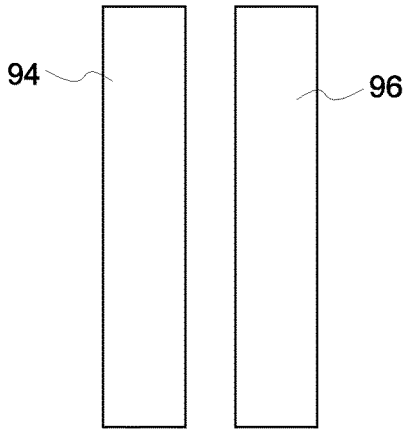

FIG. 6A shows yet another exemplary set of emitters 90. The emitter set 90 may be fabricated by depositing emitter material onto a substrate 92 to yield a plurality of emitters 94, 96 and structural ligaments 98 connecting the emitters 94, 96 together. Similar to other embodiments, the emitters 94, 96 may have meander conduction paths or may have any other suitable conduction path configuration, and the substrate 92 may be flat and may operate to fix a positional relationship between the two emitters 94, 96 to facilitate installation. FIG. 6B shows an embodiment of the emitters 94, 96 as installed where the substrate 92 has been removed. In some embodiments, the substrate 92 may be removed before the emitter set 90 is installed in the cathode assembly 50. One or more ligaments 98 may be removed for example, by a suitable removal process as mentioned above, and one or more ligaments 98 may be left in place to provide modal stiffness. In some embodiments, all the ligaments 98 may be left in place. The ligaments 98 remaining connected to the emitters 94, 96 may be adapted to achieve specific current flows through the emitters 94, 96 as will be described below. FIG. 6C shows another embodiment of the emitters 94, 96 where all of the ligaments are removed after installation.

Figure 7A:
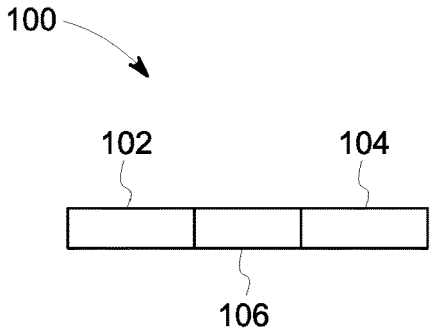
FIGS. 7A-7D show exemplary sets of emitters fabricated with ligaments having a bend according to the disclosed embodiments.
Figure 7B:
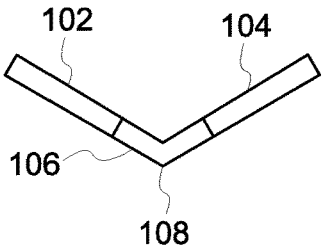
Figure 7C:
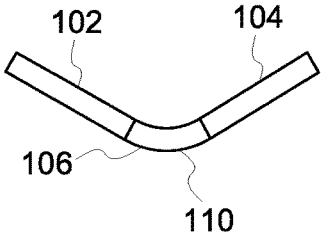
Figure 7D:
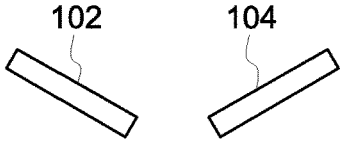

FIGS. 7A-11B show exemplary embodiments of fabricated emitter sets with out of plane emitters. FIG. 7A shows a side view of an emitter set 100 formed from a sheet of material with two emitters 102, 104 joined by one or more ligaments 106. A bend may be applied to the emitter set 100 by applying heat to the emitter set 100 until the emitter material is ductile and applying a bending force to, for example the ligament portion 106. Heat may be applied from a separate heat source or may be applied by passing a current through the emitter set 100. The bending force may be applied using a die, tooling, or other suitable bending technique to achieve a V bend 108, as shown in FIG. 7B, a rounded bend 110, as shown in FIG. 7C, or any suitable bend. The bends 108, 110 may include any number of angles to achieve a desired out of plane relationship between the emitters 102, 104. A suitable bend may be applied to achieve a particular orientation between the emitters 102, 104, such as an angular orientation, a positional orientation, or both. After installation, one or more of the ligaments 106 may be removed by a suitable removal process as mentioned above, and one or more ligaments 106 may be left in place to provide modal stiffness. In some embodiments, all the ligaments 106 may be left in place. Ligaments 106 left in place may be modified to achieve specific current flows through the emitters 102, 104 as will be described below. As shown in FIG. 7D, in some embodiments, all of the ligaments may be removed after installation.

Figure 8A:
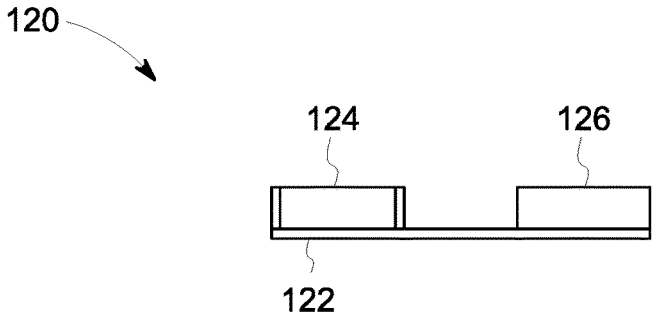
FIGS. 8A-8D show exemplary sets of emitters fabricated on a substrate having a bend according to the disclosed embodiments.
Figure 8B:
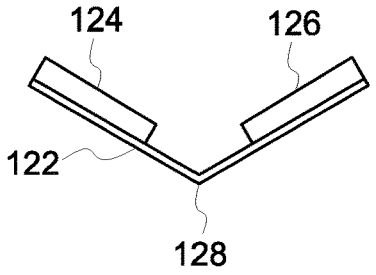
Figure 8C:
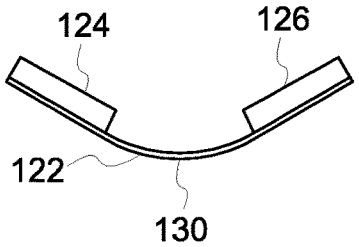
Figure 8D:
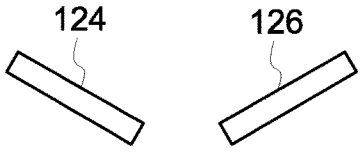

FIG. 8A shows a side view of an exemplary initial assembly for an out of plane emitter set 120 formed by depositing emitter material onto a substrate 122. In this example, a plurality of emitters 124,126 may be formed on an initially flat substrate 122 and a bend may be applied to the substrate 122 by hot forming, cold forming, or any suitable process. A V bend 128, as shown in FIG. 8B, a rounded bend 130, as shown in FIG. 8C, or any suitable bend may be applied to the substrate 122. The bends 128, 130 may include any number of angles to achieve a desired out of plane relationship between the emitters 124, 126. A suitable bend may be applied to achieve a particular orientation between the emitters 124, 126, such as an angular orientation, a positional orientation, or both. In one or more embodiments, the substrate 122 may be bent and the plurality of emitters may be formed on the substrate 122 after bending. One or more portions of the substrate 122 may be removed by a suitable removal process, and one or more portions may be left in place to provide modal stiffness. In some embodiments, the substrate 122 may be left in place. As shown in FIG. 8D, in some embodiments, substantially all of the substrate may be removed after installation.

Figure 9A:
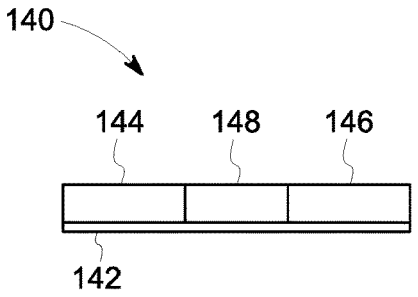
FIGS. 9A-9E show exemplary sets of emitters fabricated with ligaments on a substrate having a bend according to the disclosed embodiments.
Figure 9B:
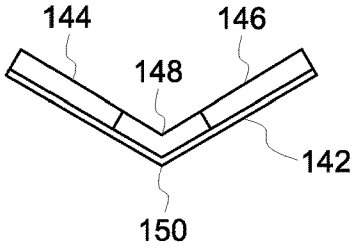
Figure 9C:
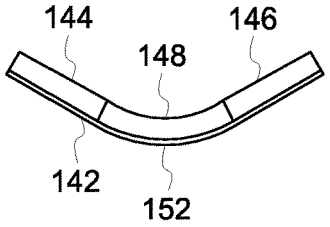
Figure 9D:
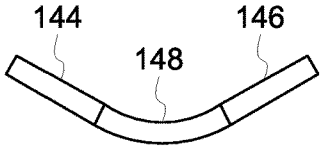
Figure 9E:
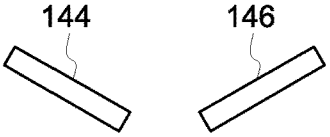

FIG. 9A shows a side view of yet another exemplary initial assembly for an out of plane emitter set 140. Similar to other embodiments, a plurality of emitters 144, 146 may be formed by depositing emitter material onto a substrate 142. A plurality of ligaments 148 connecting the emitters 144, 146 may also be formed as part of the deposition process. A bend may be applied to the initially flat substrate 142 by hot forming, cold forming, or any suitable process. A "V" bend 150, as shown in FIG. 9B, a rounded bend 152, as shown in FIG. 9C, or any suitable bend may be applied to the substrate 142. The bends 150, 152 may include any number of angles to achieve a desired out of plane relationship between the emitters 144, 146. A suitable bend may be applied to achieve a particular orientation between the emitters 144, 146, such as an angular orientation, a positional orientation, or both. In one or more embodiments, the substrate 142 may be bent and the plurality of emitters may be formed on the substrate 142 after bending. In some embodiments, the substrate 142 may be removed before the emitter set 140 is installed in the cathode assembly 50 as shown in FIG. 9D. One or more ligaments may be removed for example, by a suitable removal process as mentioned above, and one or more ligaments 148 may be left in place to provide modal stiffness. In some embodiments, all the ligaments 148 may be left in place. Remaining ligaments 148 may be adapted to achieve specific current flows through the emitters 144, 146 as will be described below. FIG. 9E shows another embodiment of the emitters 144, 146 where all of the ligaments are removed after installation.

Figure 10A:
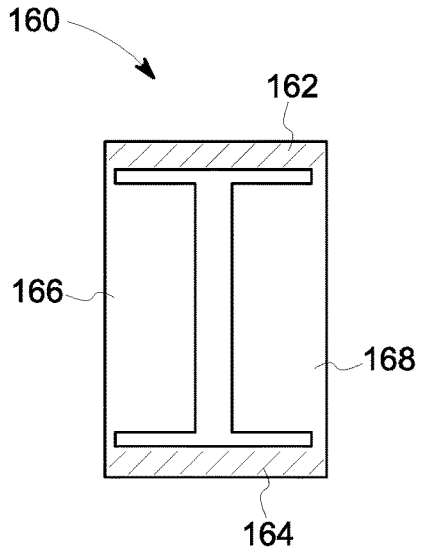
FIGS. 10A-10C and 11A-11C illustrate emitter sets with ligaments positioned at ends of the emitter sets according to the disclosed embodiments.
Figure 10B:
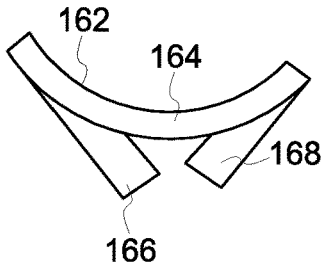
Figure 10C:
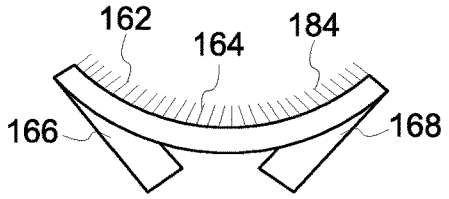

FIG. 10A illustrates a front view of an emitter set embodiment with ligaments 162, 164 at ends of the emitter set 160. In this example, the emitter set 160 may be fabricated from a sheet of emitter material cut to produce emitters 166, 168 between the ligaments 162, 164. The emitter set 160 may initially be fabricated as a substantially flat sheet of material. FIG. 10B shows a side view of the emitter set 160 where a bend may be applied to the ligaments 162, 164 by hot forming, cold forming, or any suitable process. While a round bend is shown in FIG. 10B, a "V" bend or any suitable bend may be applied to the ligaments 162, 164 at any number of angles. As shown in FIG. 100, one or more of ligaments 162, 164 may be fabricated with one or more grooves 184 to facilitate bending. A suitable bend is applied to achieve a particular orientation between the emitters 166, 168, such as an angular orientation, a positional orientation, or both. A suitable bend may be applied to achieve a particular orientation between the emitters 162, 164, such as an angular orientation, a positional orientation, or both. One or more of the ligaments 162, 164 may be removed after installation, in some embodiments the ligaments 162, 164 may be left in place, and in other embodiments all the ligaments 162, 164 may be removed. Any of the ligaments 162, 164 remaining may be modified to achieve specific current flows through the emitters 72, 74 as will be described below.

Figure 11A:
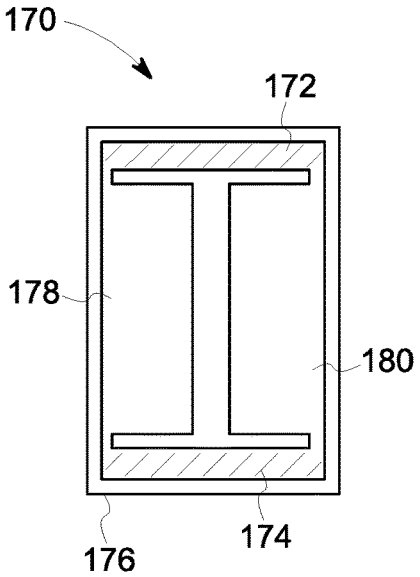
Figure 11B:
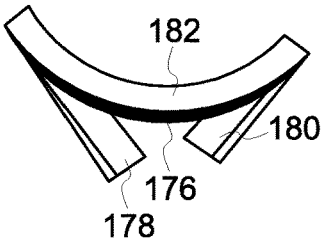
Figure 11C:
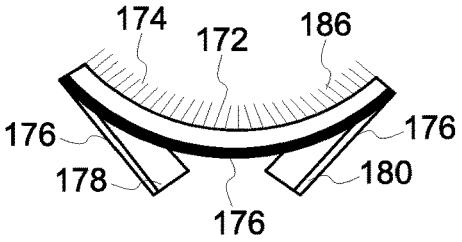

FIG. 11A shows a front view of another embodiment of an emitter set 170 with ligaments 172, 174 at ends of the emitter set 170. In this embodiment, the emitter set 170 may be formed by depositing emitter material onto a substrate 176 to form emitters 178, 180 along with ligaments 172, 174. The emitter set 170 may initially be deposited on a substantially flat substrate. FIG. 11B shows a side view of the emitter set 170 where a bend 182 may be applied to the ligaments 172, 174 by hot forming, cold forming, or any suitable process. While a round bend is shown in FIG. 11B, a "V" bend or any suitable bend may be applied to the ligaments 172, 174 at any number of angles to achieve a desired out of plane relationship between the emitters 178, 180. A suitable bend may be applied to achieve a particular orientation between the emitters 178, 180, such as an angular orientation, a positional orientation, or both. In one or more embodiments, the substrate 176 may be bent and the plurality of emitters may be formed on the substrate 176 after bending. Alternately, one or more of the ligaments 172, 174 may be removed before bending the substrate, for example, to relieve strain that may be encountered when bending the ligament material. As shown in FIG. 110, one or more of ligaments 172, 174 may be fabricated with one or more grooves 186 to facilitate bending. In some embodiments, the substrate 176 may be removed before the emitter set 170 is installed, while in other embodiments, the substrate 176 may be left in place during and subsequent to installation. In still further embodiments, the substrate 176 may be left in place during installation and then may be removed. One or more of the ligaments 172, 174 may be removed after installation, while in some embodiments the ligaments 172, 174 may be left in place, and in other embodiments all the ligaments 172, 174 may be removed. Any of the ligaments 172, 174 remaining may be modified to achieve specific current flows through the emitters 178, 180 as will be described below.

Figure 12A:
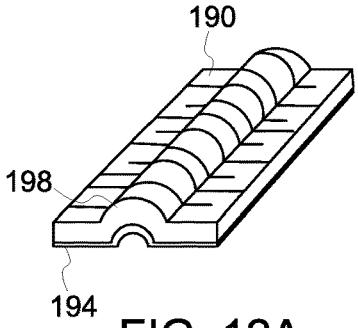
FIGS. 12A-12D illustrate emitters fabricated with stiffness and rigidity features according to the disclosed embodiments.
Figure 12B:
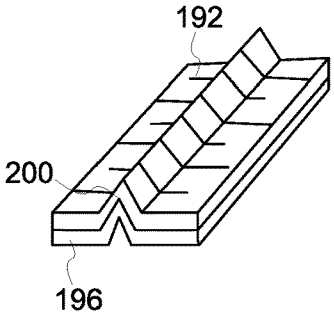
Figure 12C:
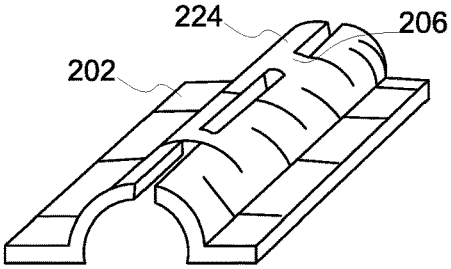
Figure 12D:
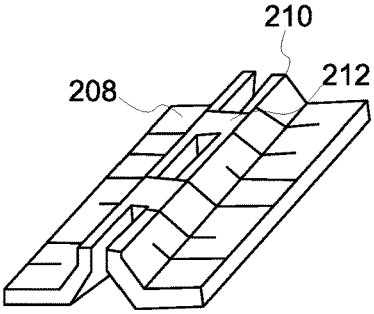

Other techniques may also be utilized to provide emitters themselves with stiffness and rigidity. For example, as shown in FIGS. 12A and 12B, an emitter 190, 192 may be fabricated with a bend, or a bend may be applied to an emitter after fabrication. In one or more embodiments, the emitters 190, 192 may be formed by depositing emitter material onto a substrate 194, 196. The substrate 194 may have a round bend 198 as shown in FIG. 12A, while the substrate 196 may have a "V" bend 200 as shown in FIG. 12B. It should be understood that the substrates 194, 196 may include any bend suitable for adding rigidity to the emitters 190, 192. In other embodiments, emitters 190, 192 may be fabricated from an emitter material sheet to which one or more bends may be applied by hot forming, cold forming, or any suitable process. The emitters may have meander conduction paths or any other suitable conduction path configuration. FIG. 12C shows an exemplary embodiment of an emitter 202 with a round bend 204 fabricated with ligaments 206. The ligaments 206 may operate to fix a positional relationship between portions of the emitter 202 and may also be adapted to effect specific current paths through the portions of the emitter 202. FIG. 12D illustrates an exemplary emitter 208 with a "V" bend 210 and fabricated with ligaments 212 which may also operate to fix a positional relationship between portions of the emitter 208 and may be adapted to effect specific current paths through the portions of the emitter 208. Fabricating the emitters 190, 192, 202, 208 with a bend or applying a bend subsequent to fabrication may provide the emitters 190, 192, 202, 208 with a focused output. For example, an emitter installed in an X-ray tube with a convex or protruding side of a bend facing the anode may produce a divergent electron beam, while an emitter installed with a concave or indented side of a bend facing the anode may produce a convergent electron beam.

Figure 13:
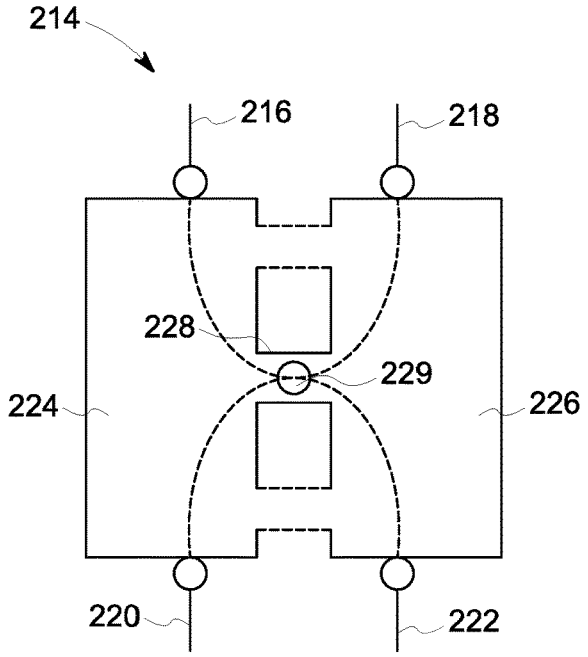
FIGS. 13, 14, 15A, and 15B illustrate the use of ligaments emitters to compensate for cold spots and defects according to the disclosed embodiments.

The ligaments between the emitters disclosed herein may be adapted to achieve specific current flows through the emitters. The specific current flows may be used for various purposes including, for example, to compensate for cold spots and defects in the emitters. FIG. 13 shows an exemplary emitter set 214 with electrical connectors 216, 218, 220, 222 for connecting the emitters 224, 226 to power supply 68. Power from power supply 68 may be used to heat the emitters 224, 226 to stimulate electron emission. The emitter set 214 may have been initially fabricated with a number of ligaments which may have been removed after the emitters 224, 226 were installed. The emitter set 214 may be installed on a post to maintain structural rigidity, however, the post may cause a cold spot 229 when the emitter set 214 is heated. In at least one embodiment, a ligament 228 may be provided to supply a current path through the cold spot 229 to generate heat to compensate for the temperature difference at the cold spot. Additional ligaments may be utilized to provide heat for other cold spots.

Figure 14:
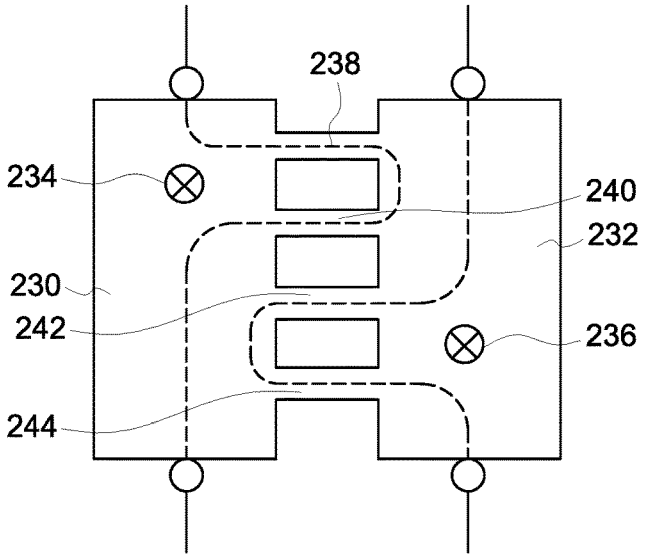

One or more ligaments may provide additional current paths to compensate for defects in emitters. FIG. 14 shows emitters exemplary 230, 232, each with a defect 234, 236. Ligaments 238 and 240 may be utilized to provide a current path around defect 234, and ligaments 242 and 244 may be utilized to provide a current path around defect 236, thus providing viability even when more than one defect may occur. Current in the vicinity of the defects 234, 236 may be reduced and emitter life may be improved because the current is diverted over a limited length.

Figure 15A:
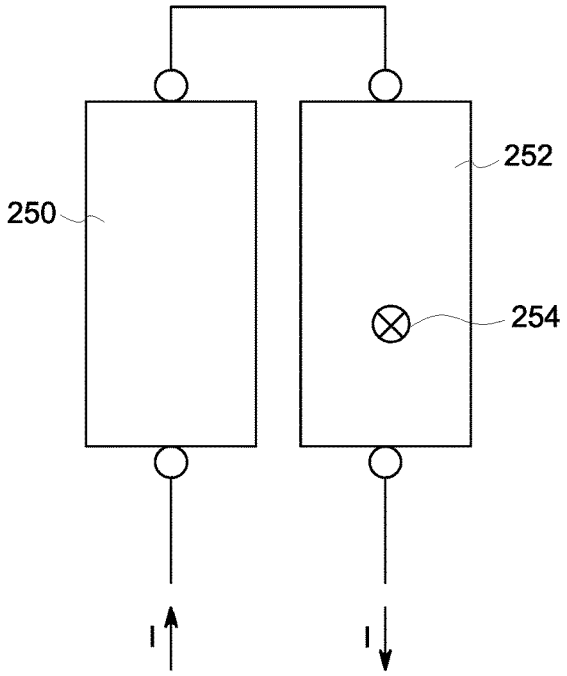
Figure 15B:
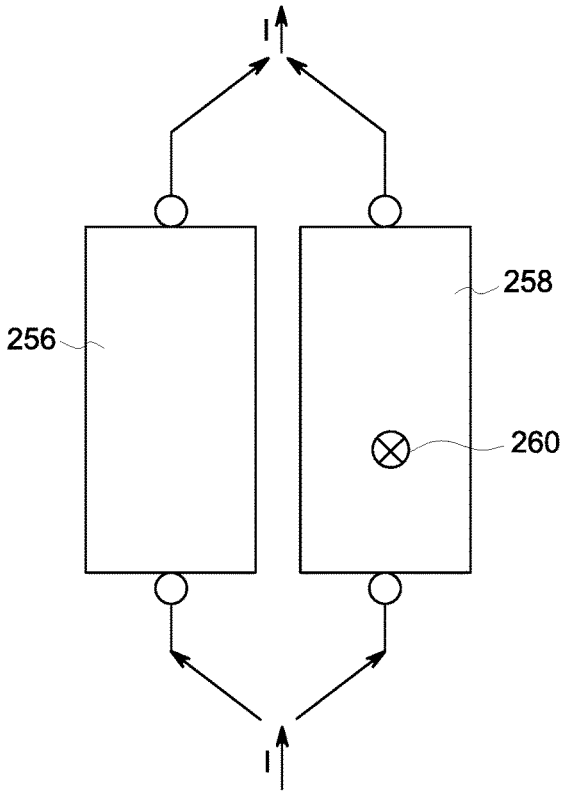

Use of an emitter set instead of a single emitter may also provide additional current connection capabilities. As shown in FIG. 15A, emitters 250, 252 may be connected in series resulting in a constant current through a defect 254. As shown in FIG. 15B, emitters 256, 258 may be connected in parallel resulting in a reduced current through a defect 260 and a longer emitter life.

While the disclosed emitter sets have been described in terms of two emitters, it should be understood that any number of emitters may be utilized as part of any of the disclosed embodiments.

While the disclosed substrates have been described and shown as a relatively flat rectangular prism or cuboid, it should be understood that the substrates may have any suitable shape or structure, for example, a cylindrical or polyhedron structure, and may be embodied as a rod with any suitable shape. Furthermore, it should be understood that while the emitters are shown as being deposited or otherwise placed on a top side of the substrates, the emitters may be placed on any side or surface of the substrates.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

While the invention has been described with reference to exemplary embodiments, it will be understood by those skilled in the art that various changes may be made and equivalents may be substituted for elements thereof without departing from the scope of the invention. Furthermore, the skilled artisan will recognize the interchangeability of various features among different embodiments and that various aspects of different embodiments may be combined together. Similarly, the various method steps and features described, as well as other known equivalents for each such methods and feature, can be mixed and matched by one of ordinary skill in this art to construct additional assemblies and techniques in accordance with principles of this disclosure. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

Furthermore, some of the features of the exemplary embodiments could be used to advantage without the corresponding use of other features. As such, the foregoing description should be considered as merely illustrative of the principles of the disclosed embodiments and not in limitation thereof.

What is claimed is:

1. An electron emitter assembly comprising:

a plurality of thermionic anisotropic polycrystalline X-ray emitter structures comprising one or more non-removable modal stiffness structures connecting the plurality of thermionic anisotropic polycrystalline X-ray emitter structures; and a removable structure connected to, and fixing a positional relationship among, individual ones of the plurality of anisotropic polycrystalline X-ray emitter structures.

2. The electron emitter assembly of claim 1, wherein the removable structure comprises one or more ligaments connected among the individual ones of the plurality of thermionic anisotropic polycrystalline X-ray emitter structures.

3. The electron emitter assembly of claim 1, wherein the removable structure comprises a substrate supporting the individual ones of the plurality of thermionic anisotropic polycrystalline X-ray emitter structures.

4. The electron emitter assembly of claim 1, wherein at least a portion of the removable structure is removable by an ablation process.

5. The electron emitter assembly of claim 1, wherein at least a portion of the removable structure is removable by a separation process.

6. The electron emitter assembly of claim 1, wherein at least a portion of the removable structure is retained.

7. The electron emitter assembly of claim 1, wherein the positional relationship among the individual ones of the plurality of thermionic anisotropic polycrystalline X-ray emitter structures is planar.

8. The electron emitter assembly of claim 1, wherein the positional relationship is an out of plane relationship among the individual ones of the plurality of thermionic anisotropic polycrystalline X-ray emitter structures.

9. The electron emitter assembly of claim 8, wherein the out of plane relationship among the individual ones of the plurality of thermionic anisotropic polycrystalline X-ray emitter structures is effected by a bend applied to the removable structure.

10. The electron emitter assembly of claim 1, wherein at least a portion of the removable structure is retained to provide a current path among the individual ones of the plurality of thermionic anisotropic polycrystalline X-ray emitter structures.

11. The electron emitter assembly of claim 1, comprising a sheet of emitter material cut to form the plurality of thermionic anisotropic polycrystalline X-ray emitter structures and the removable structure.

12. The electron emitter assembly of claim 1, wherein the plurality of thermionic anisotropic polycrystalline X-ray emitter structures comprise one or more of tungsten, tungsten alloy, tantalum, or hafnium carbide.

* * * * *